United States Patent [19]

Koike

[11] 4,062,179

[45] Dec. 13, 1977

[54] SWITCHING MECHANISM FOR AN ELECTRONIC TIMEPIECE

[75] Inventor: Yuji Koike, Matsudo, Japan

[73] Assignee: Kabushiki Kaisha Daini Seikosha, Japan

[21] Appl. No.: 643,176

[22] Filed: Dec. 22, 1975

[30] Foreign Application Priority Data

Dec. 28, 1974 Japan ..... 50-2249[U]

[51] Int. Cl.[2] ..... G04C 3/00

[52] U.S. Cl. ..... 58/23 R; 58/88 B

[58] Field of Search ..... 58/23 R, 34, 40, 46 R, 58/46 W, 50 R, 63, 64, 73, 80, 85.5, 88 B

[56] References Cited

U.S. PATENT DOCUMENTS

| | | | |
|---|---|---|---|
| 2,532,943 | 12/1950 | Riemer | 58/85.5 |
| 3,874,162 | 4/1975 | Boxberger et al. | 58/85.5 |
| 3,877,217 | 4/1975 | Hohstrate | 58/85.5 |
| 3,934,401 | 1/1976 | Wood | 58/85.5 |
| 3,952,176 | 4/1976 | Holder et al. | 58/50 R |
| 3,978,296 | 8/1976 | Morita et al. | 200/4 |

*Primary Examiner*—Robert K. Schaefer
*Assistant Examiner*—Vit W. Miska
*Attorney, Agent, or Firm*—Robert E. Burns; Emmanuel J. Lobato; Bruce L. Adams

[57] ABSTRACT

A switching mechanism for an electronic timepiece including a winding shaft having a square portion, a cam member mounted on the square portion, and a spring having a slit. The cam member is disposed extending into the slip whereby movement of said winding shaft is restricted in the axial direction. The cam includes peripheral projections which extend into the slit to define angular positions at which the spring maintains the cam fixed.

3 Claims, 4 Drawing Figures

FIG. 1
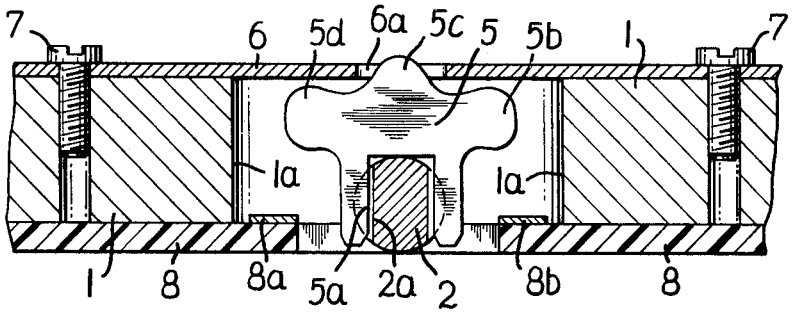
FIG. 2
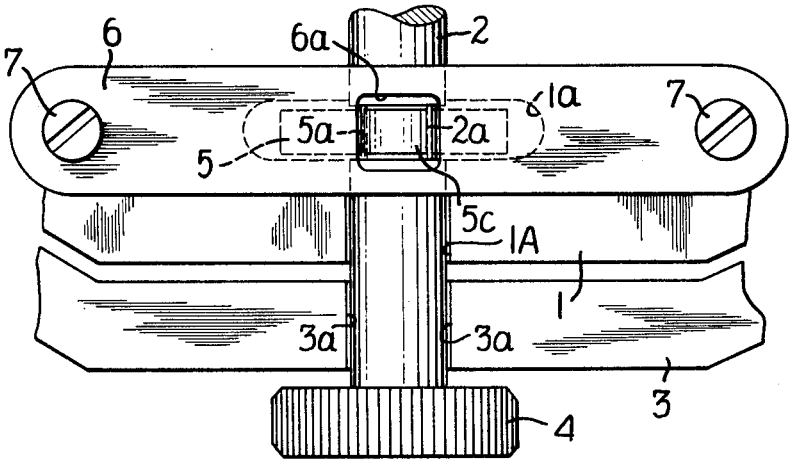
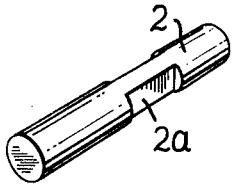
FIG. 3
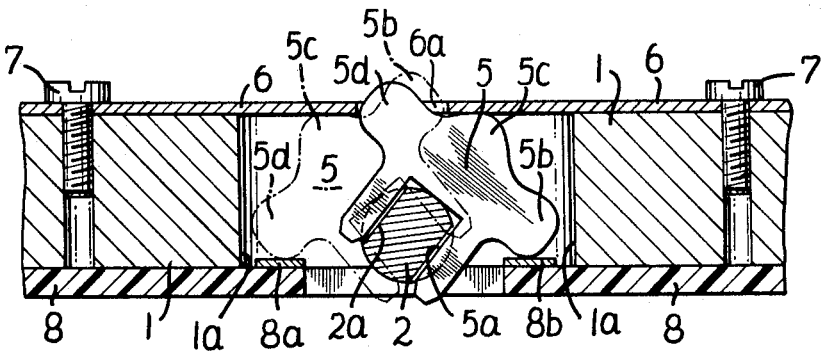
FIG. 4

SWITCHING MECHANISM FOR AN ELECTRONIC TIMEPIECE

BACKGROUND OF THE INVENTION

This invention relates to an improvement of a switching mechanism operated by a winding shaft.

There are many known types of switching mechanisms for adjusting a time of an electronic timepiece. For example, a winding shaft and stem are constructed as one body, whereby it is necessary to provide a mounting and releasing mechanism for the winding shaft. Therefore, said switching mechanism has a complicated construction, and a space occupied by said switching mechanism becomes larger.

OBJECT OF THE INVENTION

The present invention aims to eliminate the above noted difficulty and insufficiency, and therefore it is the primary object of the present invention to provide a compact and simple switching mechanism.

SUMMARY OF THE INVENTION

The switching mechanism for an electronic timepiece according to the invention comprises a winding shaft having a square portion, a cam member mounted on said square portion to rotate with the shaft, and a spring having a slit and mounted on a base member. The cam member has peripheral projections which extend into said slit whereby movement of said winding shaft is restricted in the axial direction and the spring maintains the cam at fixed angular position determined by respective ones of the peripheral projections.

BRIEF DESCRIPTION OF THE DRAWINGS

The above mentioned and further objects, features and advantages of the present invention will become more apparent from the following description when taken in connection with the accompanying drawing, which show one preferred embodiment and wherein:

FIG. 1 shows a cross sectional view of the present invention,

FIG. 2 shows a flat plan view of the present invention,

FIG. 3 shows a partial perspective view of a winding shaft of the present invention, FIG. 4 shows a cross sectional view of the present invention.

DETAILED DESCRIPTION OF THE INVENTION

This invention relates to an improvement of a switching mechanism operated by a winding shaft.

Referring now to the embodiment of the present invention illustrated in the accompanying drawings in which:

In FIG. 1, numeral 1 is a base member for a timepiece, a winding shaft 2 is mounted to a lateral hole 1A of said base member 1, and said winding shaft 2 is connected to a winding stem 4 as one body via a hole **3*a* of a case 3. A square portion 2*a* is shaped in said winding shaft 2 as indicated FIG. 3, and a cam member 5 is mounted on said square portion 2*a* via a recess portion 5*a* of said cam member 5**.

Further, protrusive portions **5*b*, 5*c* and 5*d* are shaped in and said cam member, said cam member 5 is disposed in a slit portion 1*a* of said base member 1. A spring member 6 for providing a click action is mounted on said cam member 5 with both end portions of said spring member fixedly mounted to said base member 1 via screw bolts 7, and said protrusive portion 5*c* of said cam member 5 protrudes from a window portion 6*a* of said spring member 6**.

A printed circuit board 8 is fixedly mounted under said base member 1, contact electrodes **8*a* and 8*b* of said printed circuit board 8 are disposed to the both sides of said cam member 5**.

In the above described construction as indicated in FIG. 2, said cam member 5 and said winding shaft are disposed relative to said slit portion **1*a* of said base member 1 to define as narrow a gap or space as possible to construct this mechanism without impediment whereby a contact and slide face in the axial direction of said winding shaft 2 is obtained. Therefore, said winding shaft 2 is restricted in movement relative to said base member 1 in the axial direction whereby free action and over pushing of said winding shaft 2** are limited.

Further, in the disassembly of said switching mechanism or timepiece, first said spring member 6 is removed and further said cam member 5 is removed in the upward direction whereby said winding shaft 2 is easily removed and a movement is easily taken out from the case 3.

Referring now to the operation of the switching mechanism as indicated in FIG. 4: when said cam member 5 is rotated to the right direction via said winding shaft 2, said protrusive portion **5*b* of said cam member 5 contacts the contact electrode 8*b*, and this operative position is maintained by the spring pressure action of said spring member 6 acting on the protrusive portion 5*c*. When said winding shaft 2 is rotated to the counter clockwise (left direction) against said spring pressure, said cam member 5 is kept to the neutral position in FIG. 1. Further when said winding shaft 2 is rotated in the counter clockwise direction, said cam member 5 is rotated to the left direction as indicated by the dotted line in FIG. 4 whereby the protrusive portion 5*d* contacts the contact electrode 8*a*. This operative position is maintained by the spring pressure action of said spring member 6 acting on the protrusive portion 5*c***.

According to the present invention, said cam member has three functions including the switching operation, the restricting operation of movement of said winding shaft in the axial direction and the mounting and removing operation of said winding shaft.

Therefore, one is able to construct the switching mechanism with few parts and to easily construct a small switching mechanism. Further, one is able to use a base member comprising a resin or plastic material to obtain a lower cost.

What I claim:

1. A switching mechanism for an electronic timepiece comprising, in combination:

a. a cam having a plurality of peripherally spaced peripheral projections:

b. a shaft having means for engaging said cam so that the peripheral projections of said cam are angularly positioned upon axial rotation of said shaft;

c. a base member having a bore for receiving therein said shaft and dimensioned to permit axial rotation of said shaft within said bore, and having an open recess for receiving said cam and being open above and below cam, wherein said cam within said recess limits the axial movement of said shaft relative to said base member;

d. a circuit board mounted on said base member and having contacts disposed opposite said recess containing said cam member and positioned for contacting respective ones of said peripheral projections when said cam is rotated upon rotation of said shaft; and e. a thin spring member mounted on said base member and having an aperture disposed opposite said recess containing said cam member and positioned relative to said cam member with a peripheral projection of said cam member extending therethrough, said aperture being dimensioned to permit said cam to rotate upon rotation of said shaft, and said spring member bearing against said cam member to maintain it at fixed angular positions determined by which of said projections extend into said aperture for maintaining a respective one of the peripheral projections in contact with a corresponding one of said contacts.

2. A switching mechanism according to claim 1, wherein said means for engaging said cam comprises a portion of said shaft having a generally square cross section, and wherein said cam has a recess of generally square cross section for engaging the portion of said shaft having a generally square cross section.

3. A switching mechanism according to claim 1, wherein said cam comprises a plate-like member having a major surface generally perpendicular to said shaft, and having three peripheral projections defining three angular positions at which said cam is fixed by said spring including a neutral position defined when a central one of said peripheral projections extends through said aperture at which neither of the remaining peripheral projections is in contact with said circuit board, and a pair of operative positions defined when a respective one of the non-central ones of said peripheral projections extends through said aperture and the other non-central projection contacts said circuit board.

* * * * *